US011103767B1

(12) United States Patent
Yamano

(10) Patent No.: US 11,103,767 B1
(45) Date of Patent: Aug. 31, 2021

(54) SKATEBOARD TRUCK AND SKATEBOARD FITTED WITH SAME

(71) Applicant: Masaru Yamano, Osaka (JP)

(72) Inventor: Masaru Yamano, Osaka (JP)

( * ) Notice: Subject to any disclaimer, the term of this patent is extended or adjusted under 35 U.S.C. 154(b) by 0 days.

(21) Appl. No.: 17/287,962

(22) PCT Filed: Oct. 4, 2019

(86) PCT No.: PCT/JP2019/039380
§ 371 (c)(1),
(2) Date: Apr. 22, 2021

(87) PCT Pub. No.: WO2020/085051
PCT Pub. Date: Apr. 30, 2020

(30) Foreign Application Priority Data

Oct. 25, 2018 (JP) ..... JP2018-200726

(51) Int. Cl.
*A63C 17/01* (2006.01)

(52) U.S. Cl.
CPC ..... *A63C 17/012* (2013.01); *A63C 17/015* (2013.01)

(58) Field of Classification Search
CPC ..... A63C 17/012; A63C 17/015
See application file for complete search history.

(56) References Cited

U.S. PATENT DOCUMENTS 2,719,725 A * 10/1955 Ware ..... A63C 17/02 280/11.28
3,862,763 A * 1/1975 Ware ..... A63C 17/02 280/11.28
4,398,734 A * 8/1983 Barnard ..... A63C 17/01 280/11.28
6,182,987 B1 * 2/2001 Bryant ..... A63C 17/0093 280/11.28
6,367,819 B1 * 4/2002 Andersen ..... A63C 17/0093 280/11.27
6,443,471 B1 * 9/2002 Mullen ..... A63C 17/01 280/87.042

(Continued)

FOREIGN PATENT DOCUMENTS

JP S5294965 U 7/1977
JP 2001062023 A 3/2001
WO 2012165975 A1 12/2012

OTHER PUBLICATIONS

International Search Report issued in PCT/JP2019/039380; dated Nov. 26, 2019.

(Continued)

*Primary Examiner* — Erez Gurari
(74) *Attorney, Agent, or Firm* — Studebaker & Brackett PC

(57) ABSTRACT

Provided are a skateboard track with which it is possible to improve trackability with respect to force applied to wheels in an up-down direction, and a skateboard fitted with the same. The skateboard track 3 is provided with a base 31 attached to a deck 2, and a hanger 32 attached to the base 31 by means of a king pin 38. The hanger 32 supports a pair of wheels 4 so as to be rotatable about a rotational axis extending in a left-right direction. The hanger 32 includes a pivot shaft 342 which is inclined with respect to the king pin 38, when viewed in the left-right direction. The pivot shaft 342 is attached to the base 31 so as to be movable along the axial direction of the pivot shaft 342.

7 Claims, 6 Drawing Sheets

(56) References Cited

U.S. PATENT DOCUMENTS

| | | | | |
|---|---|---|---|---|
| 6,547,262 | B1 * | 4/2003 | Yamada | A63C 17/01 280/11.28 |
| 7,104,558 | B1 * | 9/2006 | Saldana | A63C 17/0093 280/11.27 |
| 8,210,549 | B1 * | 7/2012 | Swenson | A63C 17/012 280/87.042 |
| 9,199,157 | B2 * | 12/2015 | Yamada | A63C 17/012 |
| 2018/0193722 | A1 * | 7/2018 | Iliffe, III | A63C 17/015 |

OTHER PUBLICATIONS

Written Opinion issued in PCT/JP2019/039380; dated Nov. 26, 2019.

"Decision to Grant a Patent" Office Action issued in JP 2018-200726; mailed by the Japanese Patent Office dated Feb. 15, 2019.

"Notice of Reasons for Refusal" Office Action issued in JP 2018-200726; mailed by the Japanese Patent Office dated Dec. 19, 2018.

* cited by examiner

SKATEBOARD TRUCK AND SKATEBOARD FITTED WITH SAME

TECHNICAL FIELD

A present invention relates to a skateboard truck and a skateboard to which the skateboard truck is fitted.

BACKGROUND ART

The patent literature 1 discloses a conventional skateboard truck. This skateboard truck has a mount base to be fitted to a board body, a yoke fitted to the mount base by a king bolt. The yoke has a wheel fitting shaft to which a pair of wheels separated in a left-right direction is to be fitted.

The yoke has a pivot shaft. The pivot shaft is tilted so as to be separated from the king bolt in an anteroposterior direction as the pivot shaft goes upward. The pivot shaft is fitted to the mount base via a ball bearing and is to be rotatably fitted with a central axis of the pivot shaft as a rotation axis.

CITATION LIST

Patent Literature

Patent Literature 1: Japanese Patent Application Publication No. 2001-62023

SUMMARY OF INVENTION

Technical Problem

However, with the skateboard truck disclosed in the patent literature 1, the pivot shaft can only rotate around the central axis of the pivot shaft with respect to the mount base. There is therefore a problem that the pivot shaft is impacted when a vertical force is applied to the pair of the wheels at the same time.

The present invention has been made in view of the above circumstances, and thus provides a skateboard truck and a skateboard fitted with same in each of which a pivot shaft is less susceptible to be impacted even when a vertical force is applied to a pair of the wheels at the same time.

Solution to Problem

A skateboard truck according to one aspect of the present invention has a base to be fitted to a deck, and a hanger that is fitted to the base by a kingpin and by which a pair of wheels is to be rotatably supported around a rotation axis extending along a left-right direction. The hanger has a pivot shaft extending in a direction intersecting to the kingpin as viewed in the left-right direction. The pivot shaft is movably fitted to the base along an axis direction of the pivot shaft.

A skateboard according to one aspect of the present invention has at least one of the skateboard truck, and a deck to which the skateboard truck is fitted.

Effect of the Invention

The skateboard truck and the skateboard according to the above aspects have an advantage that the pivot shaft less susceptible to be impacted even when the vertical force is applied to the pair of the wheels at the same time.

DESCRIPTION OF EMBODIMENTS

(1) Embodiment (1.1) Overall Configuration

Figure 1:
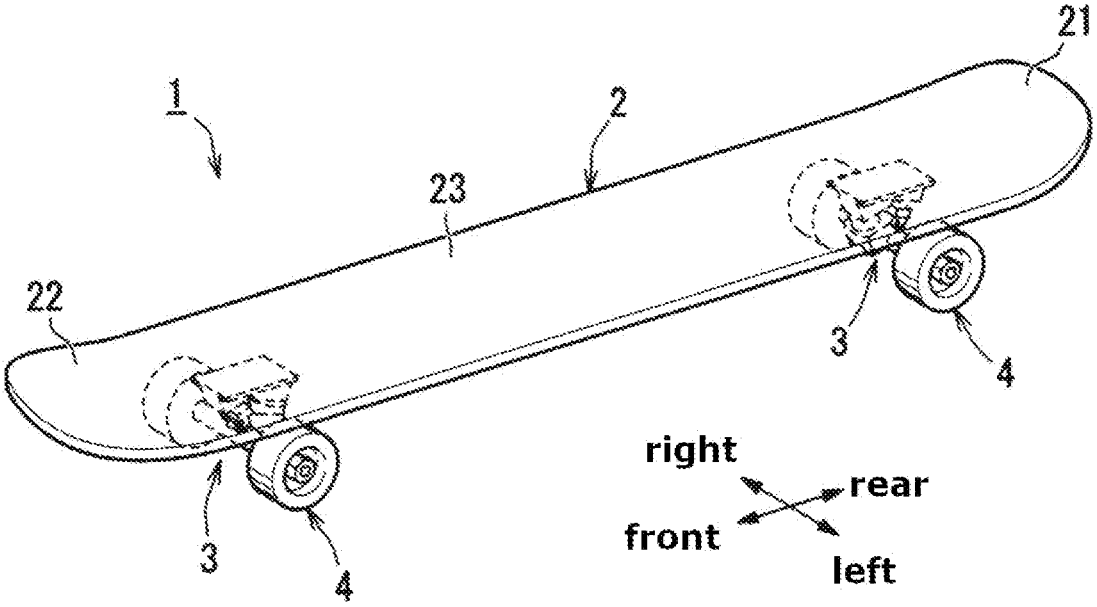
FIG. 1 is a perspective view of a skateboard according to one embodiment of the present invention.

A skateboard 1 according to this embodiment shall now be described in detail with reference to the drawings. Hereinafter, unless otherwise specified, descriptions are given assuming that the traveling surface is a horizontal surface, a traveling direction is defined as "a front direction" and an opposite direction thereof is defined as "a rear direction", and the front direction and the rear direction are sometimes collectively referred to as "an anteroposterior direction". Also, two directions orthogonal to the anteroposterior direction and along the horizontal surface are defined as "a left-right direction". However, the definitions of those directions are not intended to limit a mode of use of the skateboard 1 according to this embodiment.

The skateboard 1 according to this embodiment has a deck 2, a plurality (here two) of skateboard trucks 3 (Hereinafter truck 3), and a plurality (here four) of wheels 4.

(1.2) Deck

The deck 2 is a part on which a user rides and is composed of a plate body. As shown in FIG. 1, the deck 2 has a surface oriented upward (an upper surface) and a surface opposing the traveling surface (a lower surface). The deck 2 extends in the anteroposterior direction and is formed in an elliptical shape as viewed in plane, in this embodiment. However, in the present disclosure, the shape of the deck 2 is not limited to the elliptical shape as viewed in plane, and may be a circular shape as viewed in plane, a triangular shape as viewed in plane, a quadrangular shape as viewed in plane, a pentagonal shape as viewed in plane, or the like.

The deck 2 has a nose 22 which is an end portion of the front direction, a tail 21 which is an end portion of the rear direction, and a central portion 23, in this embodiment. The nose 22 projects in the front direction from a front side end portion of the central portion 23 as viewed in plane, and is, more specifically, inclined with respect to the traveling surface such as to be turned upward as it goes in the front direction. The tail 21 projects in the rear direction from a rear side end portion of the central portion 23 as viewed in plane, and is, more specifically, inclined with respect to the traveling surface such as to be turned upward as it goes in the rear direction. The nose 22, the central portion 23 and the tail 21 are integral and are continuous such that at least upper surfaces thereof continue smoothly.

A material of the deck 2 is not particularly limited. For example, a wood, a plastic, a carbon, a metal, etc. are appropriately adopted to the deck 2. Also, a deck tape for non-slip may be attached to the upper surface of the deck 2.

(1.3) Truck

Figure 2:
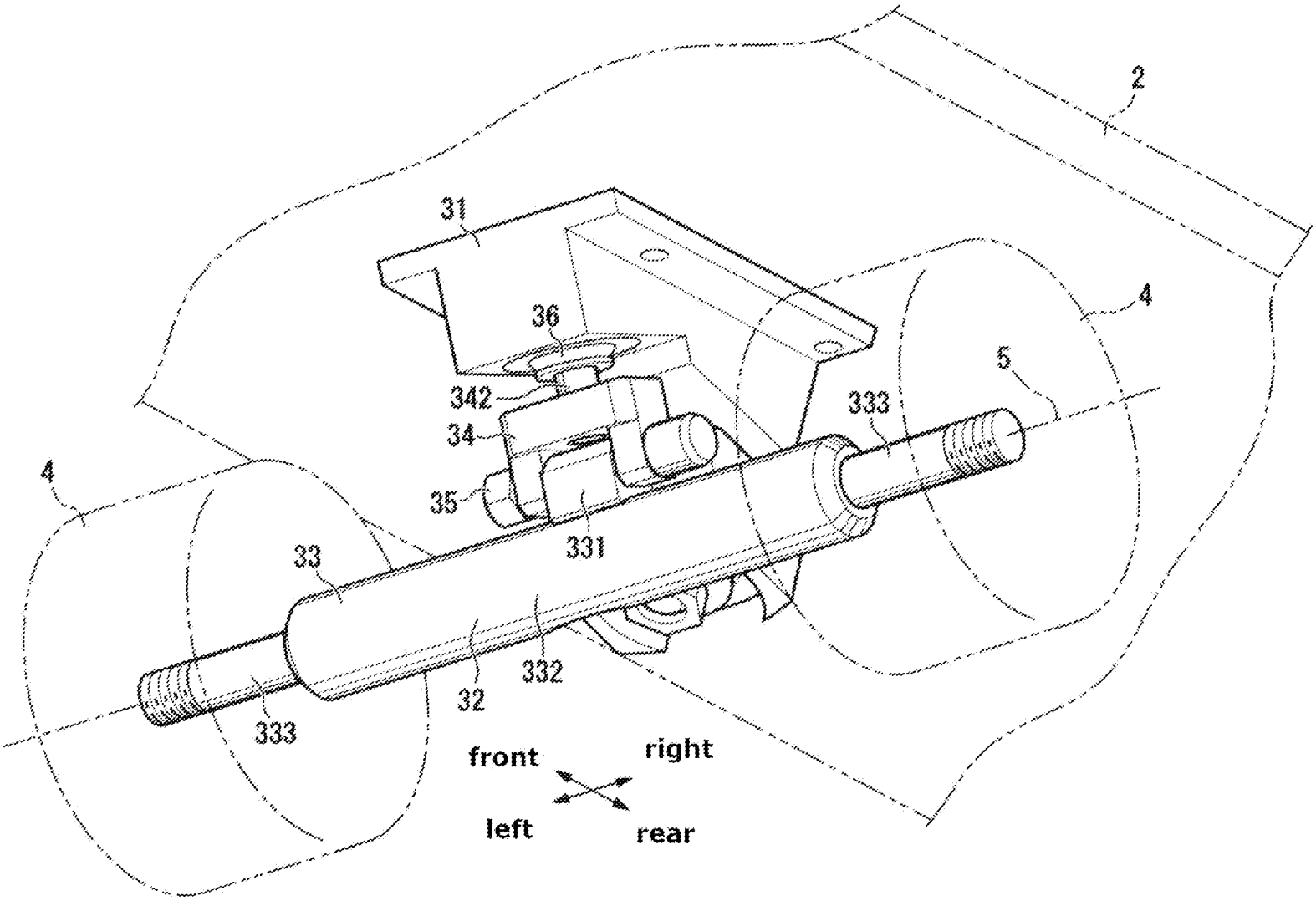
FIG. 2 is a perspective view seen from below of a skateboard truck of the skateboard.

As shown in FIG. 2, the truck 3 is a member which is to be fitted to the lower surface of the deck 2 in a state in which the wheel 4 is fitted. Two trucks 3 are fitted to the single deck 2 at an interval in the anteroposterior direction, in this embodiment. However, three or more trucks 3 may be fitted to the single deck 2. Also, the truck 3 according to this embodiment and a truck having a configuration differing from this embodiment may be combined as the plurality of the trucks 3. The two trucks 3 are the trucks 3 having same configuration and fitted symmetrically with a middle of the anteroposterior direction as a center. Hereinafter, the truck 3 fitted to a front side of the deck 2 shall be described in detail.

Figure 4:
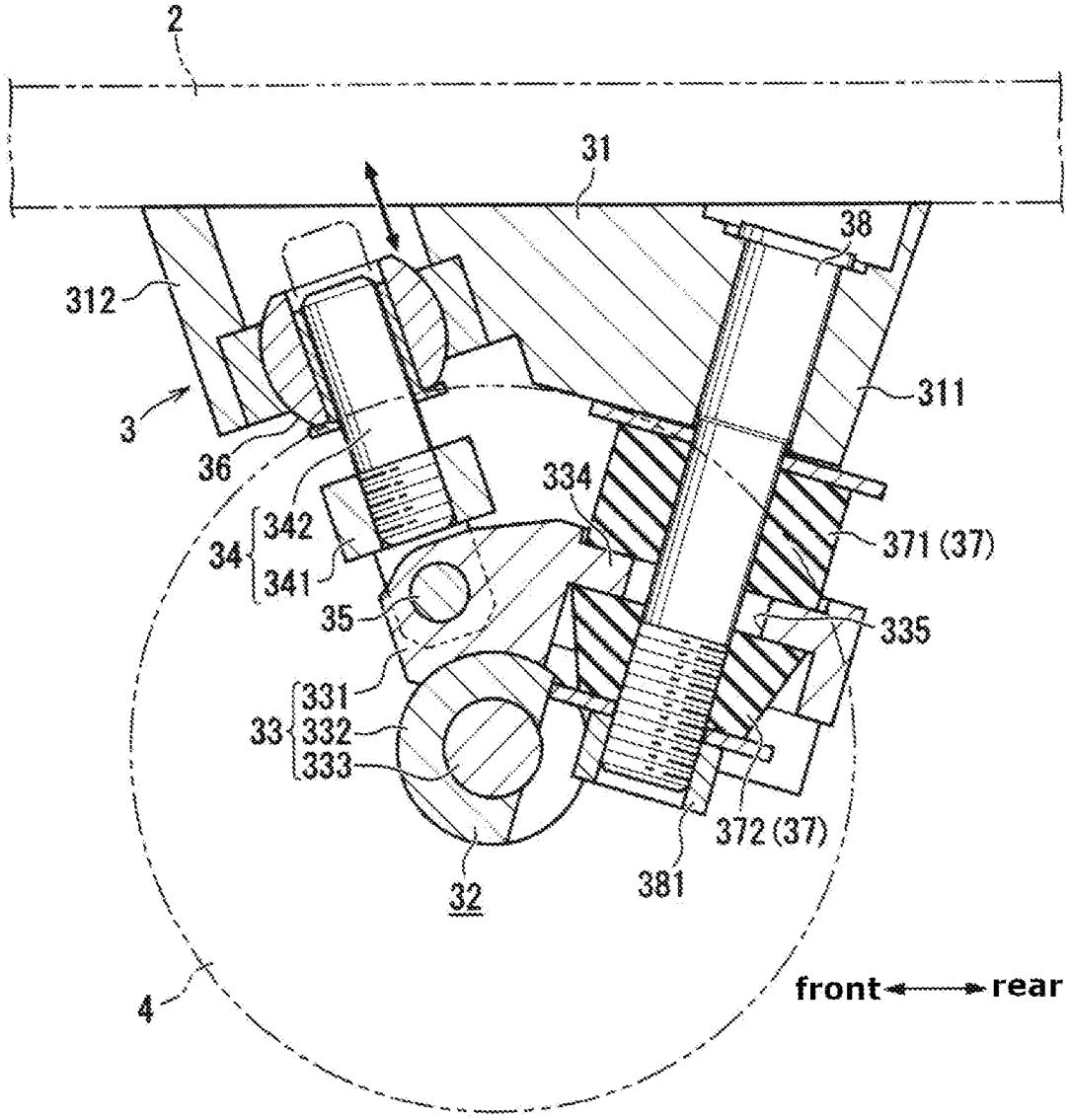
FIG. 4 is a cross-sectional view taken along line A-A shown in FIG. 3.

As shown in FIG. 2, the truck 3 has a base 31, a hanger 32 that has a pivot shaft 342, a spherical bearing 36, a bushing 37 (see FIG. 4), and a kingpin 38 (see FIG. 4).

The base 31 is to be fitted to the lower surface of the deck 2. The base 31 is a member which serves as a mounting base of the hanger 32, and composed of, for example, a metal, a synthetic resin, or the like. The base 31 is formed by an aluminum die-casting in this embodiment. As shown in FIG. 4, the base 31 has a first fitting part 311 to which the kingpin 38 is to be fitted, and a second fitting part 312 to which the pivot shaft 342 described below is to be fitted.

The first fitting part 311 is to be arranged at an inner side (here a rear side) of the anteroposterior direction of the deck 2 with respect to the second fitting part 312. The "inner side of the anteroposterior direction" here means a rear side regarding the truck 3 which is to be arranged at the front side in the deck 2, and means a front side regarding the truck 3 which is to be arranged at the rear side in the deck 2. Thus, in this embodiment, with the truck 3 which is to be arranged at the front side in the deck 2, the first fitting part 311 is located at the rear side, and the second fitting part 312 is located at the front side. Also, with the truck 3 which is to be arranged at the rear side in the deck 2, the first fitting part 311 is located at the front side, and the second fitting part 312 is located at the rear side in this embodiment. A lower surface of the first fitting part 311 is inclined with respect to the traveling surface such as to be located in a downward direction as it goes in the inner side (here the rear side) of the anteroposterior direction.

The second fitting part 312 is to be arranged at an outer side (here the front side) with respect to the first fitting part 311 in the anteroposterior direction of the deck 2. The second fitting part 312 is configured such that the pivot shaft 342 is to be fitted via the spherical bearing 36. A lower surface of the second fitting part 312 is inclined with respect to the traveling surface such as to be located in a downward direction as it goes in the outer side (here the front side) of the anteroposterior direction. The second fitting part 312 is integrated with the first fitting part 311 in this embodiment. However, in the present disclosure, the first fitting part 311 and the second fitting part 312 may be separated members, and are to be fixed to each other via the deck 2 in this case.

The bushing 37 is fitted to between respective members of the first fitting part 311, the hanger 32 and the kingpin 38, and allows a constant elastic movement of the hanger 32 relative to the base 31. The bushing 37 is made of a synthetic rubber having a predetermined elasticity in this embodiment, but may be made of, for example, a soft resin, a natural rubber, a spring, or the like in the present disclosure. In this embodiment, a plurality of the bushings 37 is provided. The plurality of bushings 37 has a first bushing 371 and a second bushing 372 in this embodiment. The first bushing 371 is arranged between the first fitting part 311 and the hanger 32 (more specifically, a tongue piece 334 described below). The first bushing 371 is formed in a cylindrical shape. The second bushing 372 is arranged between the hanger 32 and a nut 381 which is to be screwed into the kingpin 38. The second bushing 372 is formed in a truncated cone shape. The second bushing 372 has a through hole to which the kingpin 38 is to be passed through along its central axis.

The kingpin 38 is a shaft-shaped member by which the hanger 32 is to be fitted to the base 31. The kingpin 38 is composed of a bolt in this embodiment. An axis direction of the kingpin 38 is tilted with respect to the traveling surface such as to be located in the outer side (here the front side) of the anteroposterior direction as it goes in a downward direction. The kingpin 38 is configured such that the nut 381 is tightened in a state in which the first bushing 371, the hanger 32 and the second bushing 372 are passed through.

As shown in FIG. 2, the hanger 32 is a member to which the wheel 4 is to be rotatably fitted around the rotation axis 5 along the left-right direction. As shown in FIG. 4, the hanger 32 has a first member 33 and a second member 34.

The first member 33 is a part that is to be fitted to the first fitting part 311 by the kingpin 38. As shown in FIG. 2, the first member 33 has a first main body 331, a support part 332 provided at the first main body 331, and a pair of shafts 333. As shown in FIG. 4, the first main body 331 has a tongue piece 334 arranged between the first bushing 371 and the second bushing 372. The tongue piece 334 has a through hole 335 to which the kingpin 38 is to be passed through. The tongue piece 334 has a predetermined gap provided between an inner circumference surface of the through hole 335 and an outer circumference surface of the kingpin 38.

Figure 3:
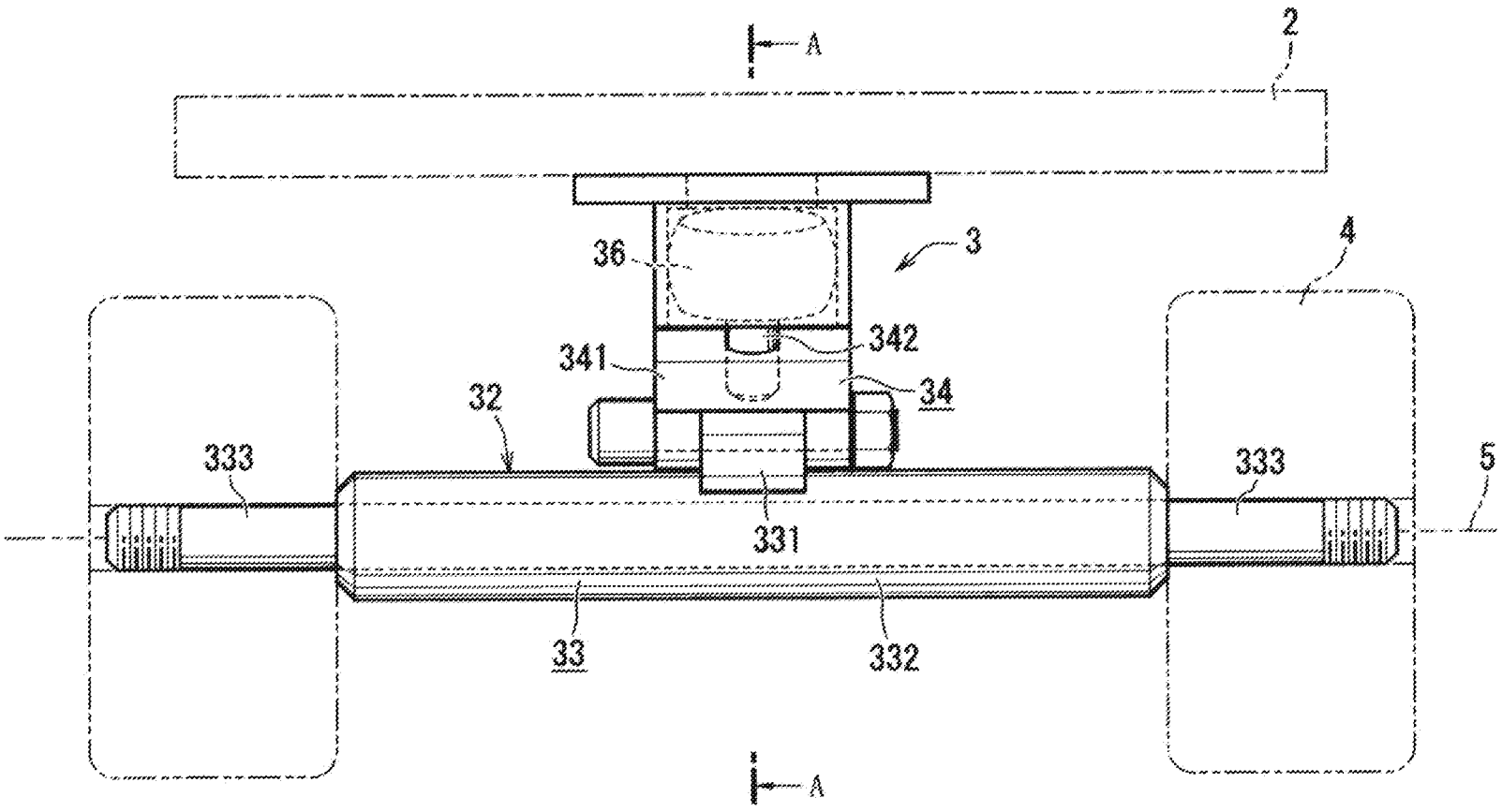
FIG. 3 is a rear view seen from a rear of the skateboard truck of the skateboard.

As shown in FIG. 3, the support part 332 is a part by which the pair of wheels 4 is to be supported. The support part 332 is formed in a columnar shape in this embodiment. The support part 332 is formed integrally with the first main body 331 by, for example, an aluminum die-casting.

The shafts 333 project outward of the left-right direction from end surfaces of the left-right direction of the support part 332 respectively. The pair of the shafts 333 is fixed to the support part 332. An outer diameter of each the shafts 333 is smaller than an outer diameter of the support part 332. Each of the shafts 333 is configured such that the single wheel 4 is to be rotatably fitted around a central axis of each of the shafts 333. The central axis of each of the shafts 333 is the rotation axis 5 to be a rotation center of the wheel 4. The rotation axis 5 thus extends along the left-right direction.

As shown in FIG. 4, the second member 34 includes a second main body 341 and the pivot shaft 342. The second main body 341 is rotatably fitted to the first main body 331 around a shaft 35 extending in the left-right direction. In other words, the second member 34 is rotatably fitted to the first member 33 around the shaft 35 parallel to the rotation axis 5.

The pivot shaft 342 is a shaft-shaped member and is provided at the second main body 341. A central axis (an axis direction) of the pivot shaft 342 is tilted with respect to the traveling surface such as to go in an upward direction as it goes in the outer side (here, the front side) of the anteroposterior direction. The pivot shaft 342 therefore extends in a direction intersecting the kingpin 38 as viewed in the left-right direction. The pivot shaft 342 is fitted to the base 31 via the spherical bearing 36.

Figure 5:
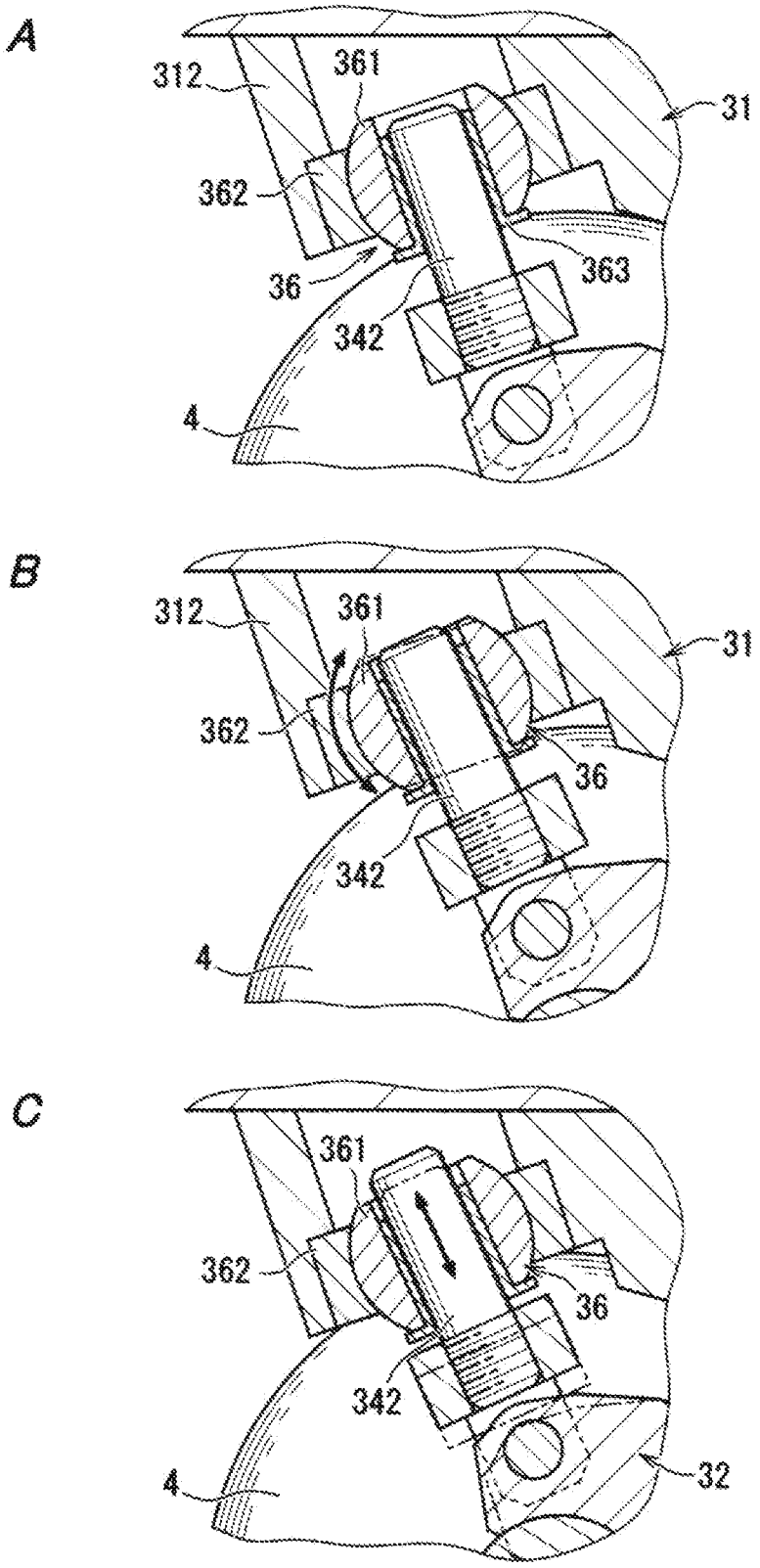
FIGS. 5A to 5C are enlarged views each showing a relationship between a pivot shaft and a spherical bearing of the skateboard truck.

The spherical bearing 36 is a bearing that receives the pivot shaft 342 in a direction orthogonal to and in a direction tilting to the lower surface of the second fitting part 312. As shown in FIG. 5A, the spherical bearing 36 has an inner ring 361 and an outer ring 362. The outer ring 362 is fixed to the second fitting part 312. The inner ring 361 has a spherical contact with respect to the outer ring 362. "The spherical contact" here includes a case in which the inner ring 361 and the outer ring 362 come into direct contact, and a case in which the inner ring 361 and the outer ring 362 come into indirect contact via a rolling body such as a ball and a columnar body or a sliding member such as Teflon (registered trademark). In short, "the spherical bearing 36" in the present disclosure includes not only a spherical sliding bearing without a plurality of rolling bodies between the inner ring 361 and the outer ring 362, but also a spherical rolling bearing with multiple a plurality of rolling bodies between the inner ring 361 and the outer ring 362.

As shown in FIG. 5B, the spherical bearing 36 can thereby pivotably receive the pivot shaft 342 relative to the base 31. "Pivotably" here means that the pivot shaft 342 is movable in a state in which the pivot shaft 342 is tilted with respect to an axis parallel to a virtual line orthogonal to the lower surface of the second fitting part 312.

Also, the pivot shaft 342 is movable between a first position (a position of a solid line shown in FIG. 4) and a second position (a position of an imaginary line shown in FIG. 4). The second position is a position in which the wheel 4 comes into closer to the deck 2 in the axis direction of the pivot shaft 342 than the first position. The pivot shaft 342 is constantly subjected to a force toward the first position by the kingpin 38 and the bushing 37, and can be elastically displaced along the axis direction of the pivot shaft 342. In short, the pivot shaft 342 is elastically and movably fitted to the base 31 along the axis direction of the pivot shaft 342. A sliding bearing 363 is interposed between the pivot shaft 342 and the inner ring 361 to reduce a friction coefficient between the pivot shaft 342 and the inner ring 361, in this embodiment. More specifically, an oilless bearing is adopted as the sliding bearing 363.

As shown in FIG. 5C, with the hanger 32 according to this embodiment, the pivot shaft 342 therefore can move in the axis direction of the pivot shaft 342 with respect to the spherical bearing 36 when a force is applied to the pair of wheels 4 in the vertical direction at the same time. The skateboard according to this embodiment is therefore excellent in a cushioning property when the traveling surface has irregularities or when an external force is applied to the wheel 4.

Figure 6:
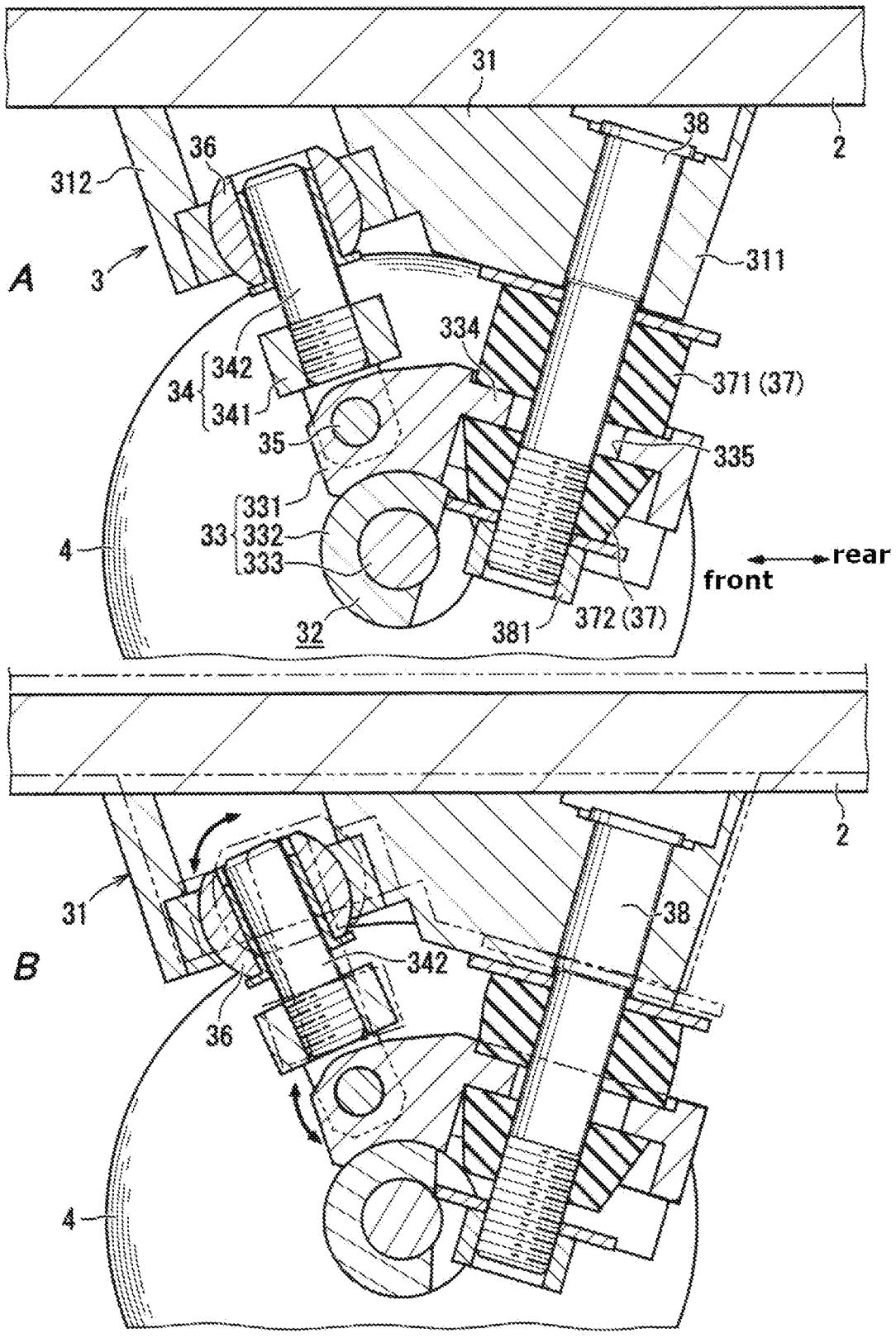
FIGS. 6A and 6B are cross-sectional views showing movements of the skateboard truck.

Also, with the hanger 32 according to this embodiment, the pivot shaft 342 is received by the spherical bearing 36. As shown in FIGS. 6A and 6B, it is therefore possible to smoothly follow a movement of the deck 2 in the left-right direction, and it is possible to improve a followability relative to a gravity center movement of the user. Moreover, with the skateboard 1 according to this embodiment, a configuration in which the pivot shaft 342 is elastically and movably fitted to the base 31 along the axis direction of the pivot shaft 342 is combined to a configuration in which the spherical bearing 36 is provided, to make the followability relative to the gravity center movement of the user become high, and it is therefore possible to handle a sudden operation of the user such as a sudden turn and a sharp curve. The skateboard 1 according to this embodiment can thereby realize high followability.

(1.4) Wheel

The wheel 4 is a wheel that is rotatably fitted to the hanger 32 around the rotation axis 5 extending in the left-right direction. Four wheels 4 are provided in this embodiment. In the skateboard 1, two wheels 4 are fitted to the single hanger 32. For the wheels 4, for example, a rubber, an urethane, a wood, an iron, a pottery, a synthetic resin, etc. may be adopted, but there is no particular limitation in in the present disclosure. In this embodiment, with respect to the wheels 4, a washer (not shown) is arranged at an inner side of the left-right direction, and a nut (not shown) is screwed at an outer side in the left-right direction.

(2) Modification Example

The above embodiment is merely one of various embodiments of the present disclosure. The embodiment can be modified in various modes depending on designs, etc., as long as the purpose of the present disclosure can be achieved. Hereinafter, modification examples of the embodiment shall be listed below. The modification examples described below can be applied in combination as appropriate.

In the skateboard 1 according to the above embodiment, the truck 3 is to be directly fitted to the lower surface of the deck 2, but a rubber spacer may be interposed between the lower surface of the deck 2 and the truck 3, in the present disclosure. In short, the fitting of the track 3 to the deck 2 also includes the fitting of the track 3 directly or indirectly to the deck 2.

In the above embodiment, the trucks 3 are arranged at the deck 2 such as to be in the symmetric with respect to the middle of the anteroposterior direction, but it does not have to be in the symmetric. For example, the truck 3 at the front side and the truck 3 at the rear side may be arranged in the same orientation. Also, in the above embodiment, the pivot shaft 342 is located at the outer side of the anteroposterior direction with respect to the kingpin 38, but the pivot shaft 342 is arranged at the inner side of the anteroposterior direction with respect to the kingpin 38.

In the above embodiment, the base 31 is formed by the aluminum die-casting, but the base 31 may be formed by, for example, a casting, a shaving-out, etc., and the formation method is not limited. Also, the base 31 is not limited to the aluminum alloy, and may be made of, for example, a metal such as a magnesium alloy, a zinc alloy, and a copper alloy, or a synthetic resin.

In the above embodiment, the first bushing 371 is formed in the columnar shape, but may have another shape such as a truncated cone shape, a prismatic shape and a truncated pyramid shape, and the shape thereof is not particularly limited.

In the above embodiment, the second bushing 372 is formed in the truncated cone shape, but may have another shape such as a columnar shape, a prismatic shape and a truncated pyramid shape, and the shape thereof is not particularly limited.

In the above embodiment, the support part 332 is formed in the columnar shape, but may have another shape such as a prismatic shape, and the shape thereof is not particularly limited.

In the above embodiment, the first main body 331 and the support part 332 are integrally formed by, for example, the aluminum die-casting, but it may be a shaving-out, etc., for example. Also, the first main body 331 and the support part 332 are not limited to the aluminum alloys, and may be made of, for example, metals such as magnesium alloys, zinc alloys and copper alloys, or synthetic resins.

(3) Aspect

As described above, the skateboard truck 3 according to the first aspect has the base 31 to be fitted to the deck 2, and the hanger 32 fitted to the base 31 by the kingpin 38. The hanger 32 is configured such that the pair of the wheels 4 is to be rotatably supported around the rotation axis 5 extending along the left-right direction. The hanger 32 has the pivot shaft 342 tilted with respect to the kingpin 38 as viewed in the left-right direction. The pivot shaft 342 is movably fitted to the base 31 along the axis direction of the pivot shaft 342.

According to this aspect, when a force is applied to the pair of the wheels 4 in the vertical direction at the same time, the pivot shaft 342 moves in the axis direction with respect to the base 31. Therefore, for example, when the traveling surface has irregularities or when an external force is applied to the wheels 4, etc., the pivot shaft 342 is less susceptible to be impacted.

In the skateboard truck 3 according to the second aspect, the pivot shaft 342 is fitted to the base 31 via the spherical bearing 36 in the first aspect.

According to this aspect, it is possible to improve the followability related to the gravity center movement of the user. In particular, the configuration in which the pivot shaft 342 is movably fitted to the base 31 along the axis direction of the pivot shaft 342 is combined to the configuration in which the pivot shaft 342 is fitted via the spherical bearing 36, to make the followability relative to the gravity center movement of the user become high, and it therefore makes it easy to respond to the sudden operation of the user such as the sudden turn and the sharp curve.

In the skateboard truck 3 according to the third aspect, the pivot shaft 342 is elastically and movably fitted to the base 31 along the axis direction of the pivot shaft 342, in the first or second aspect.

According to this aspect, it is possible to increase a cushioning property against the external force to be applied from the wheel 4.

In the skateboard truck 3 according to the fourth aspect, the hanger 32 is fitted to the kingpin 38, and has the first member 33 having the rotation axis 5 and the second member 34 having the pivot shaft 342, in any one of the first to third aspects. The second member 34 is rotatably fitted to the first member 33 around the shaft 35 parallel to the rotation axis 5.

According to this aspect, the pivot shaft 342 can be smoothly moved relative to the base 31, and the impact to be applied to the pivot shaft 342 can be further mitigated.

The skateboard 1 according to the fifth aspect has the skateboard truck 3 according to any one of the first to fourth aspects, and the deck 2 to which the skateboard truck 3 is fitted.

According to this aspect, it is possible to provide the skateboard 1 in which the pivot shaft 342 is less susceptible to impact when a force is applied to the pair of the wheels 4 in the vertical direction at the same time.

The configurations according to the second to fourth aspects are not essential configurations for the skateboard truck 3, and can be omitted as appropriate.

REFERENCE SIGNS LIST

1 Skateboard
2 Deck
3 Skateboard truck (Truck)
31 Base
32 Hanger
33 First member
34 Second member
342 Pivot shaft
35 Shaft
36 Spherical bearing
38 Kingpin
4 Wheel
5 Rotation axis

The invention claimed is:

1. A skateboard truck comprising:
a base to be fitted to a deck; and
a hanger that is fitted to the base by a kingpin and by which a pair of wheels is to be rotatably supported around a rotation axis extending along a left-right direction;
wherein the hanger has a pivot shaft extending in a direction intersecting to the kingpin as viewed in the left-right direction,
the pivot shaft is movably fitted to the base along an axis direction of the pivot shaft, and
the pivot shaft is fitted to the base via a spherical bearing.

2. A skateboard truck comprising:
a base to be fitted to a deck; and
a hanger that is fitted to the base by a kingpin and by which a pair of wheels is to be rotatably supported around a rotation axis extending along a left-right direction;
wherein the hanger has a pivot shaft extending in a direction intersecting to the kingpin as viewed in the left-right direction, and
the pivot shaft is movably fitted to the base along an axis direction of the pivot shaft, and
wherein the hanger has
a first member connected to the kingpin and having the rotation axis, and
a second member connected to the pivot shaft and rotatably fitted to the first member around an axis parallel to the rotation axis.

3. The skateboard truck according to claim 1,
wherein the hanger has
a first member connected to the kingpin and having the rotation axis, and
a second member connected to the pivot shaft and rotatably fitted to the first member around an axis parallel to the rotation axis.

4. The skateboard truck according to claim 1,
wherein the pivot shaft is elastically and movably fitted to the base along the axis direction of the pivot shaft.

5. A skateboard comprising:
the skateboard truck according to claim 1; and
a deck to which the skateboard truck is fitted.

6. The skateboard truck according to claim 2,
wherein the pivot shaft is elastically and movably fitted to the base along the axis direction of the pivot shaft.

7. A skateboard comprising:
the skateboard truck according to claim 2; and
a deck to which the skateboard truck is fitted.

* * * * *